US006158684A

United States Patent [19]

Hedlund

[11] Patent Number: 6,158,684

[45] Date of Patent: Dec. 12, 2000

[54] REELING DEVICE FOR HOSES AND/OR CABLES

[75] Inventor: Per Niclas Hedlund, Helsingborg, Sweden

[73] Assignee: AB Ph. Nedermann & Co., Helsingborg, Sweden

[21] Appl. No.: 09/243,512

[22] Filed: Feb. 1, 1999

[30] Foreign Application Priority Data

Feb. 9, 1998 [SE] Sweden ..... 9800361

[51] Int. Cl.[7] ..... B65H 75/30; A62C 35/00

[52] U.S. Cl. ..... 242/381; 242/381.6; 242/396.6; 137/355.23; 137/355.26

[58] Field of Search ..... 242/381, 396, 242/396.5, 396.6, 396.9, 381.6; 137/355.21, 355.23, 355.26; 188/290, 291

[56] References Cited

U.S. PATENT DOCUMENTS 3,211,396 10/1965 McQuillen ..... 242/381
4,446,884 5/1984 Rader, Jr. ..... 137/355.23
4,793,376 12/1988 Hare ..... 137/355.23

*Primary Examiner*—John Q. Nguyen
*Attorney, Agent, or Firm*—Tarolli, Sundheim, Covell, Tummino & Szabo L.L.P.

[57] ABSTRACT

A reeling device for hoses or cables, whereby the reeling device (1) comprises a non-rotatable member (5), a member (3) which is rotatably mounted thereon and which rotates during unrolling or reeling of the hose or cable (2), a spring device (22) for rotating the rotatable member (3) in a reeling direction for reeling or winding up the hose or cable (2) and a viscosity brake (25) for slowing down the rotary speed of the rotatable member (3) when said rotatable member is rotated in the reeling direction by the spring device. The viscosity brake (25) includes a stationary brake housing (26) which is mounted on members (38) of or connected to the non-rotatable member (5) and the viscosity brake (25) has a movable member (27) which is located inside the brake housing (26) and which includes a movement-transfer device (32) which is provided outside the brake housing (26) for obtaining movement-transfer cooperation between the rotatable member (3) and the movable member (27) of the viscosity brake (25).

7 Claims, 3 Drawing Sheets

REELING DEVICE FOR HOSES AND/OR CABLES

BACKGROUND OF THE INVENTION

The present invention relates to a reeling device for hoses and/or cables, whereby the reeling device comprises a non-rotatable member and a member rotatably mounted thereon which rotates during unrolling or reeling of the hose and/or cable, whereby a spring device is connected to the non-rotatable member and adapted to cooperate with the rotatable member such that the spring device a) is stretched when the rotatable member is rotated in an unrolling direction when the hose and/or cable is unwound or drawn out from the reeling device and b) after drawing out the hose and/or cable from the reeling device the rotatable member is rotated in a reeling direction for reeling or winding up the hose and/or cable on the reeling device, whereby a viscosity brake is provided to slow down the rotary speed of the rotatable member when said rotatable member is rotated in the reeling direction by the spring device and whereby the viscosity brake includes a stationary member, a movable member and a brake fluid therebetween.

SUMMARY OF THE INVENTION

Reeling devices with viscosity brakes are previously known from U.S. Pat. No. 4,446,884. At the reeling device according to said publication, the viscosity brake consists of a brake housing which is movable since it is fixedly attached to the rotatable member and rotatable therewith. In the brake housing there is provided a stationary member which is fixedly attached to an anchor sleeve which in turn is fixedly attached to a shaft forming part of the non-rotatable member. Between the stationary member and the movable brake housing there is located a brake fluid.

There are some drawbacks at this prior art viscosity brake and because of its location. Thus, said viscosity brake is a complicated structure since it requires several separate sealing and bearing elements between the stationary anchor sleeve and the movable brake housing. Furthermore, the use of an anchor sleeve leads to that the viscosity brake must be given a large outer diameter, which means that there must be large spaces in the rotatable member such that there is room for the viscosity brake. Additionally, the rotatable member must be demounted from the non-rotatable member for providing access to the viscosity brake for exchange, adjustment or maintenance thereof.

The object of the present invention is to eliminate these drawbacks and therefore, the invention is given the characterizing features of subsequent claim 1.

Since the reeling device is provided with said characterizing features, it is achieved a) that the viscosity brake is less complex and smaller and thereby less expensive;

b) that no space is required therefor in the rotatable member;

c) that it is easily accessible for exchange, adjustment or maintenance;

d) that it is easy to install later in existing reeling devices.

BRIEF DESCRIPTION OF THE DRAWING

The invention will be further described below with reference to the accompanying drawings, in which.

DETAILED DESCRIPTION OF THE INVENTION

Figure 1:
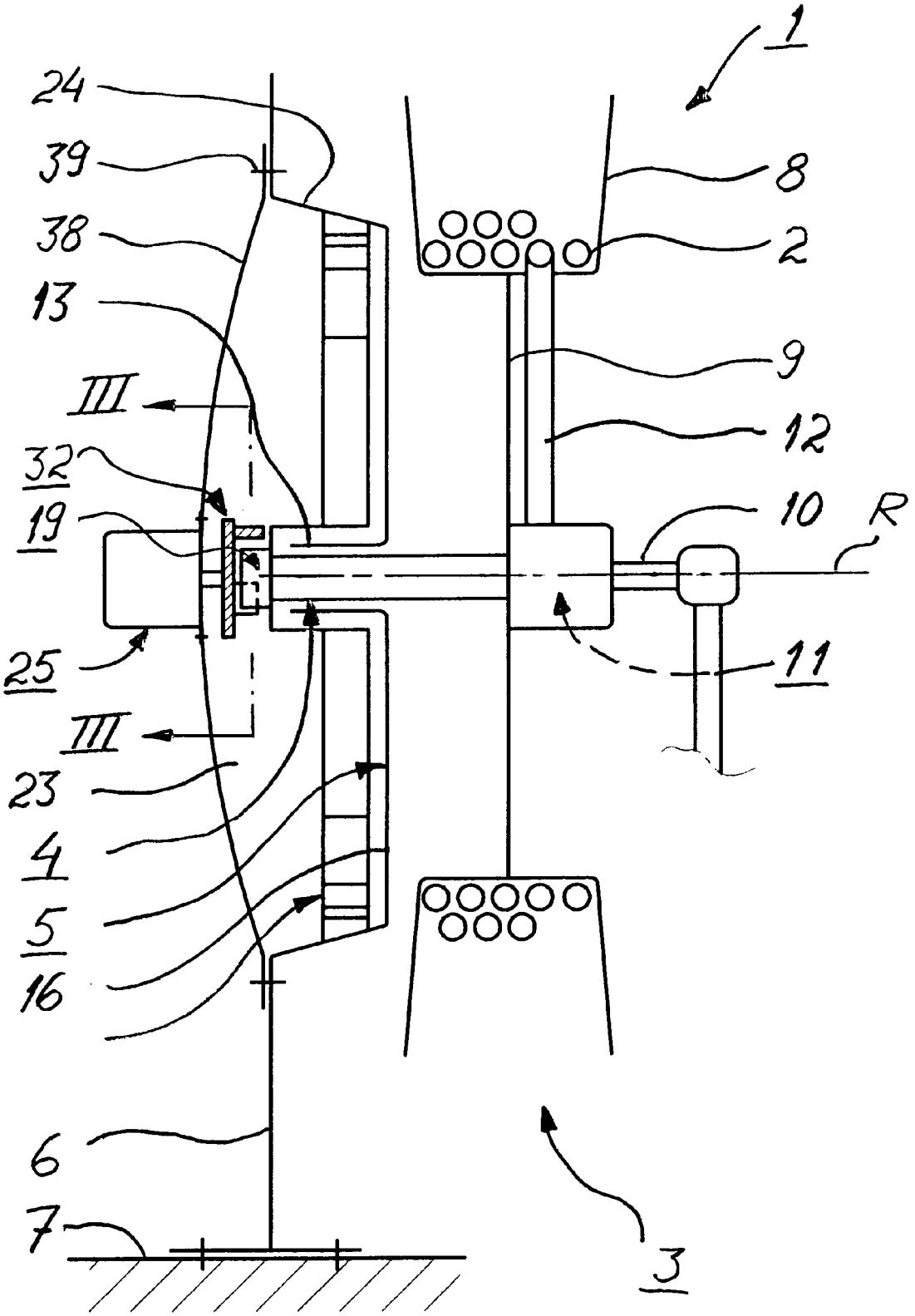
FIG. 1 is a sectional view schematically illustrating a reeling device according to the invention.

The reeling device 1 illustrated in the drawings is adapted for reeling or winding-up hoses 2 and comprises a rotatable member which is mounted for rotation in a reeling direction and an unrolling direction. The rotatable member may be a drum 3 which through bearing members 4 is rotatably mounted on a non-rotatable member, preferably a stand 5. Said stand 5 is through an anchor portion 6 mounted on an underlayer 7, e.g. a wall, a floor or a movable device.

The drum 3 is provided on one side of the stand 5 (in the figures on the right side of the stand 5) and includes an outer annular member 8 which forms a circumferentially extending recess for the hose 2 and an inner radially directed wall 9, from the interior of which the bearing members 4 protrude in an axial direction towards the stand 5.

A hose portion 10 is axially directed and centered with an axis of rotation R about which the drum 3 rotates and this hose portion 10 is through a tight rotary coupling 11 connected to a radially outwards to the hose 2 directed and thereto connected hose portion 12. The rotary coupling 11 is of a type known per se and allows the hose member 12 to rotate along with the drum 3 relative to the hose portion 10, which is not moving, whereby no leakage occurs between said hose portions 10, 12.

The bearing members 4 has a shaft 13 which is journalled or mounted on the stand 5 at two locations, namely, at first hand, closest to the wall 9 through a bearing 14 in an inner bearing sleeve 15 of the stand which is directed inwards from one side 16 of the stand 5 and, secondly, through a bearing 17 in an outer bearing sleeve 18 of the stand which is directed outwards from said one side 16 of the stand 5. Outer portions of the shaft 13 are located axially outside the outer bearing sleeve 18 of the stand and on these outer portions there is provided an outer end portion 19 of coupling members 20, preferably in the form of a coupling sleeve, which surround the outer bearing sleeve 18 of the stand and extend therealong. The outer end portion 19 is fixedly attached to the shaft 13 by means of a bolt 21 or a corresponding anchor means such that said shaft 13 and the outer end portion 19 form a rotatable member and at inner portions of the coupling sleeve 20 there is provided an inner end portion of a spring device 22. This spring device 22 is located in a space 23 which is formed around the outer bearing sleeve 18 of the stand and limited inwards by the side 16 of the stand 5 and in radially outwards direction by outer portions 24 of the stand which are directed from said side 16 of said stand primarily axially outwards. At these outer portions 24 of the stand 5 there is provided an outer end portion of said spring device 22, which can be constructed and operate in a manner known per se.

The reeling device 1 operates in a wellknown manner such that when the drum 3 rotates in an unwinding or unrolling direction when someone pulls in the hose 2 for unwinding thereof, the spring device 22 is stretched for being able to rotate the drum 3 in an opposite wind-up or reeling direction for winding up the hose 2 thereon. In order to momentarily maintain the drum 3 in a certain position when the hose 2 is unrolled, there is normally a locking device, the blocking function of which can be released by slightly pulling out the hose 2. Such a locking device may be of a type known per se and it has therefore not been illustrated or described in detail. At the embodiment described above such a locking device may preferably be located in the space 23. The blocking function can be interrupted by quickly pulling out the hose 2 a short distance. When you thereafter let go of the hose 2, it is wound-up on the drum 3 by rotation thereof in the reeling direction by means of the spring device 22.

A viscosity brake 25 is provided for breaking or slowing down the rotation of the drum 3 in the reeling direction generated by the spring device 22, so that the rotary speed of the drum 3 does not become so high that problems arise. This viscosity brake 25 is provided on the opposite side of the stand 5 relative to the drum 3 so that there is no need for separating the drum 3 from the stand 5 for mounting or demounting the viscosity brake 25.

The viscosity brake 25 comprises a brake housing 26 which is adapted to be stationary mounted and inside said brake housing 26 a movable member 27 in the form of a so called rotor is rotatably mounted. The brake housing 26 has inwardly directed flanges 28 and the movable member 27 has a shaft 29 with outwardly directed flanges 30 which protrude into the space between said inwardly directed flanges 28. Inside the brake housing 26 there is a brake fluid 31, e.g. silicone fluid or hydraulic oil, between the flanges 28, 30 for slowing down the rotary movement of the movable member 27 relative to the stationary brake housing 26.

The shaft 29 of the movable member 27 extends out of the brake housing 26 and is, outside said brake housing, provided with a movement-transfer device, preferably a coupling device 32. This coupling device may be a so called claw clutch or claw coupling having a circular plate 33 provided radially on the shaft 29 and a number, preferably three, of coupling claws 34 protruding from said plate in axial direction relative to the axis of rotation R. The coupling claws 34 of the claw clutch 33 are provided to fit with coupling surfaces 35 on the outer end portion 19 and these coupling surfaces 35 can be defined by said outer end portion 19 externally having an angular shape, e.g. a hexagon shape. The coupling device 32 can be mounted quickly simply by threading said coupling claws 34 on the end portion 19 in axial direction.

The brake housing 26 also has an outwardly directed mounting flange 36 with holes for bolts 37 which can be inserted through holes in a casing 38 so that the brake housing 26 can be mounted on the casing 38. This casing 38 can be mounted on the stand 5 by means of bolts 39 and it is adapted to seal the space 23 from the outside. The casing 38 has an opening 40 into which the coupling device 32 is insertable for connection to the outer end portion 19 so that the rotary movements of said outer end portion 19 through said coupling device 32 are transferred to the movable member 27 of the viscosity brake 25. After mounting of said viscosity brake 25 on the casing 38, the brake housing 26 will be located on the outside of said casing while the coupling device 32 will be situated completely or partly inside said casing.

Figure 2:
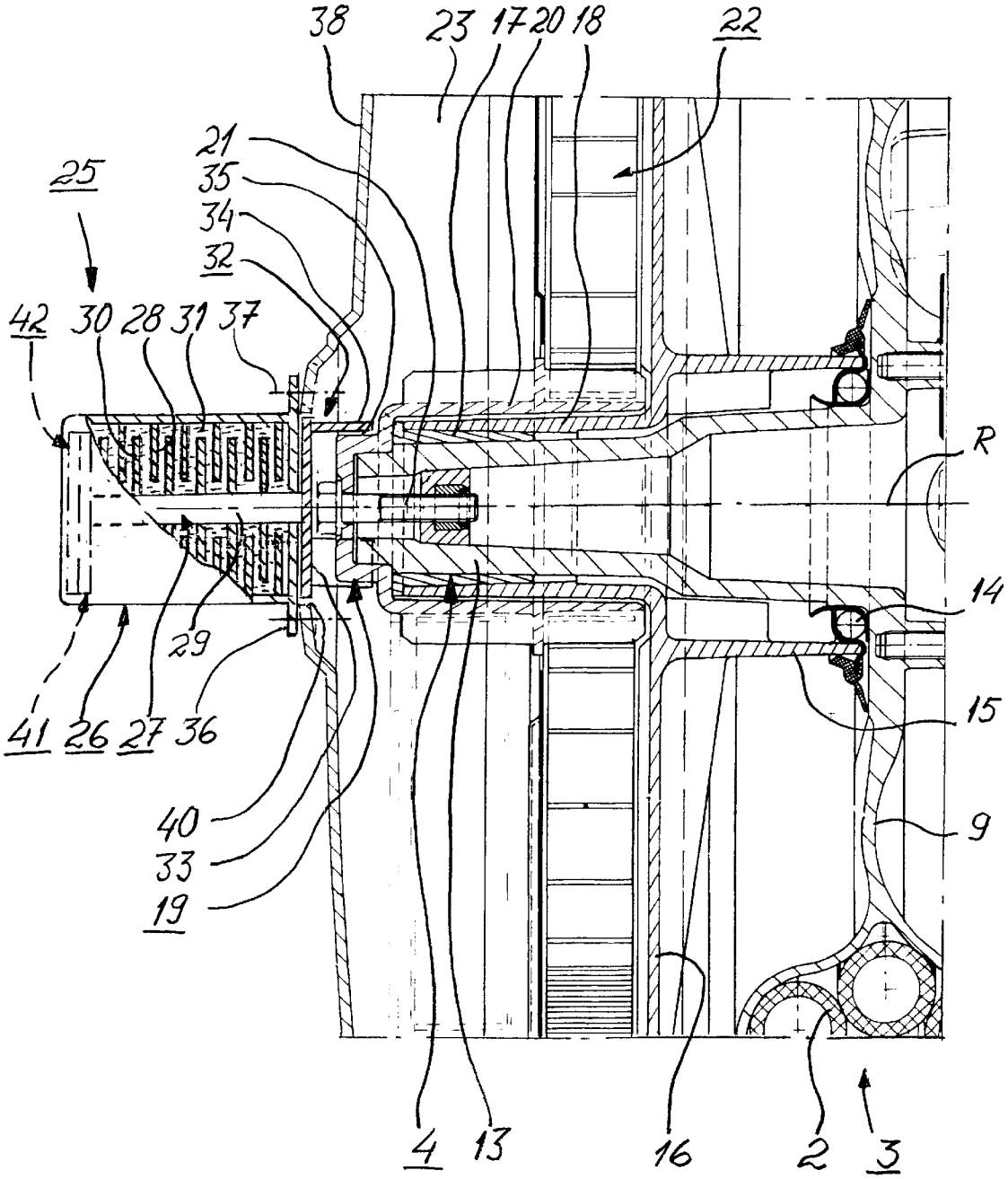
FIG. 2 is an enlarged view of a part of the reeling device of FIG. 1.
Figure 3:
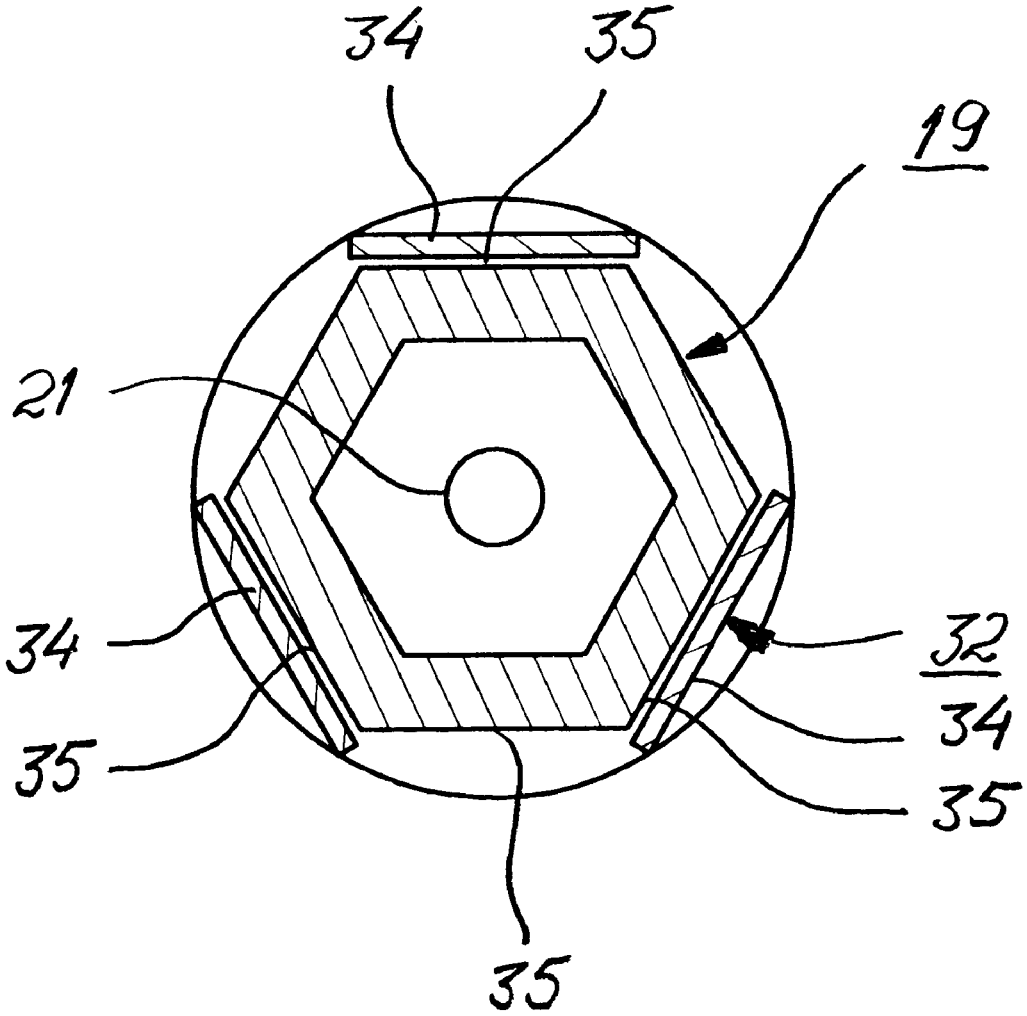
FIG. 3 is a section along the line III—III in FIG. 1 through parts of the reeling device.

The viscosity brake may also include a release device 41 for releasing the movable member 27 so that said movable member 27 does not rotate relative to the brake housing 26 when the drum 3 is rotated in the unrolling direction, whereby the viscosity brake 25 does not brake or slow down the rotation of the drum 3 when the hose 2 is unwound therefrom. The release device 41 may be of a type known per se and is therefore only schematically illustrated with dashed and dotted lines in FIG. 2.

The viscosity brake 25 may also comprise a setting device 42 for varying its brake action. Such a setting device 42 may be of a type known per se and is therefore only schematically illustrated with dashed and dotted lines in FIG. 2.

The invention is not limited to the reeling device described above and illustrated in the drawings, but may vary within the scope of the following claims.

As examples of embodiments which are not described, it can be mentioned that the drum may have more than one hose and/or one or more cables, there may be more than one spring device and the viscosity brake may be mounted directly on the stand or any other mamber than the casing which is connected to the stand.

The reeling device 1 may include another rotatable member 3 than a drum. Thus, the rotatable member 3 may instead consist of an arm (not shown) which rotates relative to a non-rotatable reeling and unrolling member. When the hose 2 is drawn out from the reeling device 1, said arm is rotated relative to said reeling and unrolling member. For reeling, the arm is rotated by means of the spring device 22, so that the hose 2 is wound-up on the reeling and unrolling member.

What is claimed is:

1. A reeling device for a hose or a cable comprising:

a non-rotatable member and a rotatable member, the rotatable member being attached to and rotatable with respect to the non-rotatable member for winding and unwinding a hose or a cable, a spring device, one end of the spring device being connected to the non-rotatable member and the other end of the spring device being connected to the rotatable member, the spring device stretching when the rotatable member is rotated with respect to the non-rotatable member during the unwinding of the hose or cable, and a viscosity brake for slowing the rotation of the rotatable member, the viscosity brake being mountable 6 to and dismountable from the non-rotatable member without detachment of the rotatable member from the non-rotatable member, the viscosity brake having a stationary member and a movable member, the stationary member being a brake housing, the movable member being partially located in and rotatable with respect to the brake housing, the movable member including a movement-transfer device, the movement-transfer device being located on a portion of the movable member that extends outside the brake housing and being selectively movable relative to the brake housing to selectively couple to and decouple from the rotatable member, a brake fluid contained within the brake housing of the viscosity brake for resisting the rotation of the movable member when the movement-transfer device is coupled to the rotatable member.

2. The reeling device according to claim 1, the reeling device being further defined by:

a casing being attached to the non-rotatable member, the casing defining a space in which the spring device is located, the viscosity brake attaching to the casing on a side opposite the rotatable member.

3. The reeling device according to claim 2, the reeling device being further defined by:

the casing having an opening, the viscosity brake attaching to the casing such that the movement-transfer device of the movable member extends through the opening.

4. The reeling device according to claim 1, the reeling device being further defined by:

the rotatable member having an outer end portion, the movement-transfer device being connected to the outer end portion when the movement-transfer device couples the rotatable member.

5. The reeling device according to claim 4, the reeling device being further defined by:

the outer end portion being fixedly attached to a shaft, the shaft protruding axially from a radially directed wall of the non-rotatable member, the shaft being mounted on an inner bearing sleeve and on an outer bearing sleeve.

6. The reeling device according to claim 1, the reeling device being further defined by:

the movement-transfer device being a coupling device with coupling members which are directed axially out from the movable member of the viscosity brake, the rotatable member having an outer end portion located on a side of the rotatable member nearest the movement-transfer device, the coupling device coupling the outer end portion when the coupling device is moved axially into cooperation with the rotatable member.

7. The reeling device according to claim 1, the reeling device being further defined by:

an inner surface of the brake housing of the viscosity brake having a plurality of inwardly directed flanges, and the movable member of the viscosity brake having a plurality of outwardly directed flanges, each outwardly directed flange extending into a space formed between respective inwardly directed flanges, each outwardly directed flange moving within the respective space when the viscosity brake is coupled to the rotatable member and the rotatable member is being wound or unwound.

* * * * *